350-284 SR
2/2/88 XR 4,723,091

United States Patent [19]
Kawamura et al.

[11] Patent Number: 4,723,091
[45] Date of Patent: Feb. 2, 1988

[54] TECHNIQUE FOR PREVENTING REFLECTIONS IN A CATHODE RAY TUBE

[75] Inventors: Hiromitsu Kawamura; Akira Misumi; Masayoshi Ezawa; Katsumi Kobara, all of Mobara; Yoshiyuki Odaka, Isumi, all of Japan

[73] Assignee: Hitachi, Ltd., Tokyo, Japan

[21] Appl. No.: 720,599

[22] Filed: Apr. 8, 1985

[30] Foreign Application Priority Data

Apr. 13, 1984 [JP] Japan ..... 59-72753

[51] Int. Cl.[4] ..... H01J 29/88; H01J 29/89
[52] U.S. Cl. ..... 313/478; 358/252; 350/284

[58] Field of Search ..... 313/478, 479; 350/164, 350/284; 358/252

[56] References Cited

U.S. PATENT DOCUMENTS 2,599,739 6/1952 Barnes ..... 313/478 X
3,114,668 12/1963 Guiles ..... 313/478 X
3,679,451 7/1972 Marks et al. ..... 358/252 X

*Primary Examiner*—Leo H. Boubreau
*Assistant Examiner*—K. Wieder
*Attorney, Agent, or Firm*—Charles E. Pfund

[57] ABSTRACT

The panel face plate of a cathode ray tube is provided with an irregular film which is formed by spraying a mixed solution of silicon hydroxide, alcohol and alkyl acetate onto the panel face plate.

3 Claims, 1 Drawing Figure

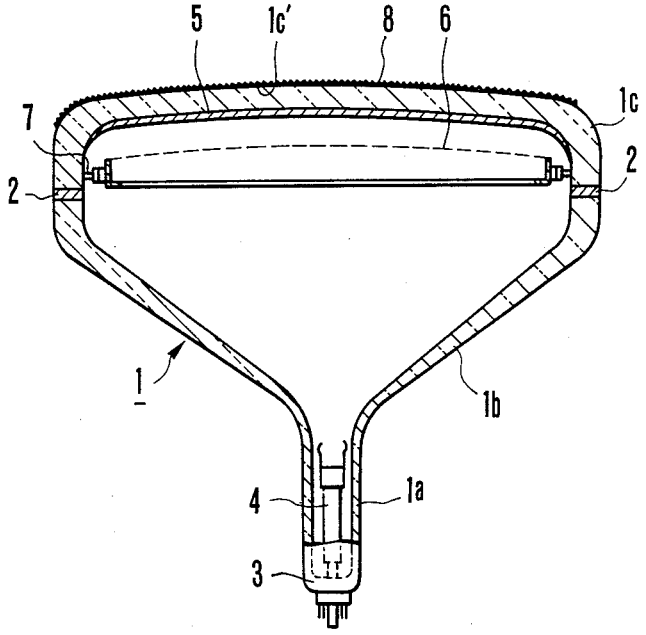
5
1c'
8
6
7
1c
2
2
1
1b
4
1a
3

TECHNIQUE FOR PREVENTING REFLECTIONS IN A CATHODE RAY TUBE

BACKGROUND OF THE INVENTION

This invention relates to a cathode ray tube and more particularly a structure for preventing reflection at the panel surface of a cathode ray tube.

Generally, the panel surface of the cathode ray tube is flat and smooth and strongly reflects external light, thus making it difficult to view a picture image displayed on the screen. As an approach to this problem, an improved cathode ray tube has been proposed in which the panel surface is subjected to a non-glare treatment so as to diffuse and reflect the external light. Various methods have been proposed for causing diffused reflection at the panel surface. According to one method, glass of the panel surface of the cathode ray tube is selectively etched with hydrofluoric acid for rendering irregular or coarse the panel surface. This method is used practically in certain cases by carefully controlling the conditions of the method, but this method accompanies such various problems that there is a tendency of raising environmental pollution, that tube is liable to be damaged, that the reclaiming is impossible, and that this method can not be applied to finished tube. According to another method, so-called sandblast method, a polishing agent is blasted against the pannel surface to render it irregular. This method is disadvantageous in that it is impossible to obtain uniform quality, that reclaiming is impossible, and that there is a fear of contamination caused by such a foreign matter as polishing agent. According to still another method, a plastic film is coated on the panel surface. But this method is also problematic in that the surface of the plastic film is liable to be damaged or scratched, and that the plastic film is dissolved in an organic solvent.

According to a method disclosed in Japanese Utility Model Publication No. 11150/69, an alkali salt aqueous solution of silicic acid (generally called water glass) is sprayed onto the panel surface of the cathode ray tube with a spray gun or the like and then the sprayed panel surface is heat treated to form an irregular or uneven film on the panel surface. In this method, however, since the applied solution contains alkali, the film reacts with moisture in air to become milky white or the film surface dissolves. Therefore, this method is not practical. Japanese Utility Model Publication No. 26277/75 discloses a method of forming a film having fine irregularity by spraying a mixed solution of silicon tetrachloride and alcohol or ester on the surface of the panel of a cathode ray tube. This method can provide an excellent film. But, the sprayed solution is acidic containing hydrochloric acid, resulting in problems that the spray nozzle is corroded, and that the solution must be stored and handled carefully. Moreover, if reacting on the electron gun, halogen ions of the hydrochloric acid will decrease its emission capability to decrease life of the cathode ray tube. Usually, in the massproduction process, it happens that unsealed cathode ray tubes are laid near a cathode ray tube to be sprayed (this cathode ray tube has been sealed) and residual halogen ions prevailing after completion of spraying tend to react on the unsealed cathode ray tubes. Accordingly, it is necessary to perfectly remove the residual halogen ions with the result that the number of fabrication steps is increased to increase cost of fabrication.

SUMMARY OF THE INVENTION

Accordingly, it is an object of this invention to provide an improved cathode ray tube in which the face surface of the panel of a cathode ray tube is made coarse to cause diffused reflection which is effective to make clear displayed pictures.

According to this invention, there is provided a cathode ray tube comprising a bulb having a panel face plate with its inner surface formed with a fluorescent screen luminiferous under bombardment of electron beams, and a film formed by using a solution of a mixture of silicon hydroxide, alcohol and an alkyl acetate on the outer surface of the panel face plate, having an optically uneven surface. In a modification, aceton and acetic acid are added to the mixture.

BRIEF DESCRIPTION OF THE DRAWING

In the accompanying drawing, P a single FIGURE is a sectional view showing essential parts of one example of the cathode ray tube embodying the invention.

DESCRIPTION OF THE PREFERRED EMBODIMENT

The bulb 1 of the cathode ray tube shown in the accompaying drawing is comprised of a neck portion 1*a*, a funnel portion 1*b*, and a panel portion 1*c* closing the opening of the funnel portion 1*b* through frit glass 2. Inside the neck portion 1*a* is placed an electron gun assembly 4 supported by a stem 3, while the inner surface of a face plate of the panel portion 1*c* is formed with a fluorescent screen 5. A shadow mask 6 is supported by a mask support 7 interiorly of the panel portion 1*c* to oppose the fluorescent screen 5. A solution of a mixture of silicon hydroxide, alcohol and alkyl acetate or the mixture added with aceton and acetic acid is sprayed onto the outer surface of the panel face plate 1*c*′ to coat thereon a film 8 of the mixture having an uneven, coarse surface. Then the bulb is heat treated to securedly fix the film 8 to the panel face plate. In this case, impurity content in the chloric constituent of the mixed solution is limited to be less than about 20 ppm. Further, alkali ion content in the mixed solution is also limited to be less than about 5 ppm. To obtain the film 8 having a surface of uniform coarseness, a spray method is preferably used. In this method, the amount and shape of particles to be deposited on the surface of a specimen (the surface of panel face plate of cathode ray tube) is adjusted by a nozzle of spray gun. The amount and shape of deposited particles depends on a distance between the specimen and spray gun, a composition of coated solution (kind and content), an air pressure of a compressor used for the spray gun, an ejection rate of solution and a spraying time. In this case, when fine liquid droplets sprayed in the form of a mist reaches the surface to be coated, that is, the face surface 1*c*′, the liquid droplets undergo partial decomposition to lose fluidity to leave solvents over the surface because the face surface 1*c*′ is preheated to a temperature of 40° C. to 100° C. Thus, a film having a coarse surface of continuous irregularity and secured to the panel face plate surface is formed. Thereafter, the panel face plate surface is heated and dried at a temperature of 120° C. to 250° C. for 15 to 30 minutes so that the film is strongly bonded to a glass material of the face surface 1*c*′. Moreover, the strength of the film 8 is also improved so that it will not be peeled off or scratched.

A concrete example will be described as follows. A mixed solution consisting of a solute, as silicon hydroxide, containing 5 weight % of dissolved silica solid component, and a solvent consisting of 63 weight % of ethyl alcohol, 26 weight % of ethyl acetate, 10 weight % of aceton, and 1 weight % of acetic acid was prepared. Then the mixed solution was sprayed to a panel face plate surface of a 14" cathode ray tube by using a spray gun under the following conditions (1) to (5):

(1) use of a stainless spray nozzle which is durable against chemical corrosion,
(2) an air pressure of compressor of 3.5 $Kg/cm^2$,
(3) a spraying time of 2.0 minutes,
(4) an ejection rate of liquid from the nozzle of 15 ml/min, and
(5) a distance between the nozzle and the specimen surface of 30 to 40 cm.

In this case, the face surface 1*c*′ of the panel portion was preheated to a temperature of about 60° C. After coating, a coated layer was heat treated at a temperature of about 150° C. for 20 minutes to form an excellent film 8 having optimum surface irregularity on the face surface 1*c*′.

In another example, aceton and acetic acid were removed from the solution of the composition in the above example. A mixed solution consisting of a solute, as silicon hydroxide, containing 5 weight % of dissolved silica solid component, and a solvent consisting of 70 weight % of ethyl alcohol and 30 weight % of butyl acetate was prepared. The mixed solution was sprayed and heat treated under the same conditions as in the above example to form an excellent film 8.

A cathode ray tube manufactured by the method described above can positively diffuse and reflect external light impinging upon the face surface 1*c*′ so that even during day time or under illumination of lamps, it is possible to correctly view displayed pictures without being fascinated by uniform reflection by the face surface 1*c*′. Moreover, the cathode ray tube can be manufactured readily, and there is no fear of damaging the film 8 during use, thereby elongating the useful life. The electric resistance of the film 8 lies in a range of $1\times10^9$ to $1\times10^{11}$ ohm·cm to prevent the face surface 1*c*′ from being charged with electricity. Moreover, as the film 8 is constituted essentially by $SiO^2$, or quartz glass, its refractive index is from 1.42 to 1.50 which is smaller than that of the glass material of the panel portion 1*c*. Consequently, the film 8 acts as an efficient reflection prevention film because not only of its surface irregularity but also of its optical nature.

As described above according to this invention, the external light impinging upon the face plate of the panel of a cathode ray tube is positively diffused and reflected so that the displayed pictures can readily be viewed. Moreover, different from the prior art cathode ray tube, there is no fear of peeling off and damage of the film. Accordingly, the cathode ray tube of this invention can be highly reliable and can form a high quality film at a high yeild with good productivity.

What is claimed is:

1. A cathode ray tube comprising a bulb having a panel face plate with its inner surface formed with a fluorescent screen which luminesces under bombardment of electron beams, and a film formed by using a solution of a mixture of silicon hydroxide, alcohol and alkyl acetate on the outer surface of said panel face plate, said film consisting essentially of silicon dioxide and having an optically uneven surface.

2. The cathode ray tube according to claim 1 wherein said mixted solution is sprayed on to a pre-heated panel face plate, and is subsequently heat treated.

3. The cathode ray tube according to claim 1 wherein said solution is sprayed on to a pre-heated panel face plate, and is subsequently heat treated.

* * * * *